US009930747B2

(12) United States Patent
Manahan et al.

(10) Patent No.: US 9,930,747 B2
(45) Date of Patent: Mar. 27, 2018

(54) FAIL-SAFE LED SYSTEM

(71) Applicant: Cooper Technologies, Houston, TX (US)

(72) Inventors: Joseph Michael Manahan, Manilus, NY (US); Hui Zhang, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/483,692

(22) Filed: Apr. 10, 2017

(65) Prior Publication Data

US 2017/0295615 A1 Oct. 12, 2017

Related U.S. Application Data

(60) Provisional application No. 62/320,674, filed on Apr. 11, 2016.

(51) Int. Cl.
*H05B 33/08* (2006.01)

(52) U.S. Cl.
CPC ..... *H05B 33/089* (2013.01); *H05B 33/0815* (2013.01); *H05B 33/0827* (2013.01)

(58) Field of Classification Search
CPC .. H05B 33/0827; H05B 37/03; H05B 37/032; H05B 37/036; H05B 37/04; H05B 39/10; H05B 39/105
USPC ..... 315/192
See application file for complete search history.

(56) References Cited

U.S. PATENT DOCUMENTS 6,194,839 B1 * 2/2001 Chang ..... H05B 33/0821 315/185 R
6,288,497 B1 * 9/2001 Chang ..... H05B 33/0803 315/185 R
7,265,504 B2 9/2007 Grant
7,317,287 B2 1/2008 Blumel
(Continued)

FOREIGN PATENT DOCUMENTS

JP 2015-41410 A 3/2015
JP 2016-48702 A 4/2016
(Continued)

OTHER PUBLICATIONS

International Search Report and Written Opinion for Application No. PCT/US2017/026847 dated Sep. 20, 2017.

*Primary Examiner* — Jason M Crawford
(74) *Attorney, Agent, or Firm* — Merchant & Gould P.C.

(57) ABSTRACT

The present disclosure relates to a fail-safe LED system including an LED circuit arrangement. The LED circuit arrangement includes a plurality of LED strings arranged in parallel with respect to each other. The LED circuit arrangement is supplied with electrical current from a constant current power supply. The fail-safe LED system includes structure for detecting a in at least one of the LED strings a failure that causes increased current to pass through remaining operational LED strings of the plurality of LED strings. The fail-safe LED system also includes a current correction string arranged in parallel with respect to the plurality of LED strings. When activated in response to the detection of a failure, the current correction string accommodates current from the constant current power supply such that the current passing through each operational LED string is reduced to a corrected current level.

23 Claims, 6 Drawing Sheets

(56) References Cited

U.S. PATENT DOCUMENTS

| | | | | |
|---|---|---|---|---|
| 7,893,626 | B2 * | 2/2011 | Liu | H05B 33/0827 315/185 R |
| 8,354,799 | B2 | 1/2013 | Yang et al. | |
| 8,674,621 | B2 | 3/2014 | Ge et al. | |
| 2008/0106205 | A1 * | 5/2008 | Wada | H05B 33/0827 315/89 |
| 2008/0211421 | A1 * | 9/2008 | Lee | H05B 33/0806 315/250 |
| 2013/0099670 | A1 * | 4/2013 | Jin | H05B 33/0815 315/120 |
| 2013/0271018 | A1 * | 10/2013 | Luo | H05B 33/0824 315/192 |
| 2014/0062314 | A1 | 3/2014 | Moskowitz | |
| 2014/0097750 | A1 * | 4/2014 | Gangi | H05B 33/0827 315/88 |
| 2014/0169037 | A1 * | 6/2014 | Berard | H05B 33/0803 362/612 |
| 2014/0191673 | A1 * | 7/2014 | Yoon | H05B 33/0809 315/192 |
| 2014/0210372 | A1 | 7/2014 | Chang | |
| 2015/0042925 | A1 | 2/2015 | Hu et al. | |
| 2015/0326117 | A1 * | 11/2015 | Tischler | H05B 33/0815 315/185 R |

FOREIGN PATENT DOCUMENTS

| | | | |
|---|---|---|---|
| KR | 10-2011-0087037 | A | 8/2011 |
| KR | 10-2013-0022810 | A | 3/2013 |

* cited by examiner

FAIL-SAFE LED SYSTEM

RELATED APPLICATIONS

The present disclosure claims benefit from U.S. Provisional Patent Application No. 62/320,674 filed on Apr. 11, 2016, the disclosure of which is incorporated herein in its entirety.

TECHNICAL FIELD

The present technology is related generally to light-emitting diodes ("LEDs"). More particularly, the present technology is related to parallel string LED systems.

BACKGROUND

A light-emitting diode (LED) uses the phenomenon of electroluminescence to convert electricity into light. The core structural element of an LED is the p-n junction. A p-n junction is an interface defined between two types of semiconductor materials (e.g., a p-type and an n-type) within a crystal of a semiconductor. P-n junctions will only conduct electricity in one direction. Hence, LEDs will only generate light when installed with the correct electrical polarity. When a voltage is applied across the p-n junction in the correct direction (i.e., with the anode coupled to the p-side of the p-n junction and the cathode coupled to the n-side of the p-n junction), current flows through the p-n junction and light is emitted from the LED. If the voltage is applied across the p-n junction in the incorrect direction (e.g., with the anode coupled to the n-side of the p-n junction and the cathode coupled to the p-side of the p-n junction), little to no current flows through the p-n junction and no light is emitted. Additionally, when an LED fails, the p-n junction may form an open circuit through which current cannot pass from either direction.

LED technology has increasingly become integrated into mainstream lighting system design. Thus, LED luminaires are commonly used across a wide range of lighting applications. Example lighting applications include residential lighting, industrial lighting, lighting for exit signs, floodlights, linear lighting, and lighting for hazardous applications such as explosion-proof lighting. Compared to traditional light sources, LED luminaires can deliver longer life, enhanced energy efficiency, greater eco-friendliness, greater resistance to vibration, lower maintenance demands and equal or better quality of light. Another significant advantage provided by LED luminaires is the ability of LED luminaires to operate at relatively low temperatures. Low temperature operation is particularly advantageous for lighting applications in hazardous environments such as environments where explosion-proof lighting is required.

SUMMARY

With regard to LED devices, it is common in the industry to drive a plurality of LED strings with one constant current power source. With this type of circuit arrangement, when a parallel string LED device experiences a failure in one of the LED strings, higher than normal current levels are supplied to the remaining operable LED strings because a higher percentage of the total constant current supplied by the constant current power supply passes through the remaining operable LED strings. Additional current passing through the operational LED strings generates additional heat at the lenses of the operational LEDs as compared to when the LEDs are operating at normal current levels. This increased heat generation can represent an ignition source particularly in hazardous/explosion-proof applications, and it can also result in an unsafe condition due to material failure in non-hazardous applications. Various industrial standards require lens temperatures be verified to prove maximum allowable temperatures of the product/components are not exceeded (e.g., the LED's silicon lens itself). Aspects of the present disclosure relate to methods, systems, structures, configurations, and devices for controlling current levels in parallel string LED devices when one or more of the LED strings fail.

Aspects of the present disclosure relate to cost-effective methods, devices and systems for making parallel string LED devices more reliable and fail-safe. Certain examples of the present disclosure relate to a parallel string LED device having a current correction string that is activated as a surrogate or substitute for a failed LED string so that operative parallel LED strings of the LED device continue to operate at normal current levels, or near to normal current levels, despite the presence of the failed LED string.

Aspects of the present disclosure relate to an LED system having a plurality of parallel LED strings driven by a constant current power source (e.g., a constant current LED driver). The LED system also includes a current correction string that is in parallel with respect to the plurality of LED strings. When one of the LED strings fails, the current correction string is activated to function as a surrogate or substitute for the failed LED string. When the current correction string is activated, a portion of the current from the constant current power source passes through the current correction string and therefore is not required to pass through the operational LED strings. In this way, excess current can be prevented from passing through the operational LED strings. Instead, the current that normally would pass through the failed LED string passes through the current correction string such that the same or near the same amount of current passes through the operational LED strings before and after failure of one of the LED strings. In certain examples, the current correction string has an effective resistance that is comparable to the resistance of the failed LED string. In certain examples, the current correction string can include a switch that is engaged when a failure of one of the LED strings is detected. In certain examples, the LED system can include monitoring circuitry that monitors operation of the LED system to determine when a failure of one or more of the LED strings occurs and to activate the current correction string when the failure is detected.

Another aspect of the present disclosure relates to a fail-safe LED system including a constant current power source and an LED circuit arrangement. The LED circuit arrangement has an anode side and a cathode side. The LED circuit arrangement includes a plurality of LED strings extending between the anode and cathode sides of the LED circuit arrangement. The LED strings are arranged in parallel with respect to one another. Each of the LED strings includes at least one LED (or a plurality of serially arranged LEDs) positioned between the anode and the cathode sides of the LED circuit arrangement. The constant current power source is coupled to the anode side of the LED circuit arrangement such that the constant current power source is adapted to provide current to each of the LED strings with the current being divided between the LED strings. The fail-safe LED system also includes a current correction string that extends between the anode and the cathode sides of the LED circuit arrangement. The current correction string is positioned in parallel with respect to each of the LED strings of the LED circuit arrangement. The current correction string includes a switch which has an open state and an engaged state. In the open state, the switch prevents current from flowing through the current correction string between the anode and cathode sides of the LED circuit arrangement. In the engaged state, the switch allows current to flow through the current correction string between the anode and cathode sides of the LED circuit arrangement. The fail-safe LED system further includes control circuitry that monitors whether the LED circuit arrangement is operating in a normal operating state or a failed operating state. The control circuitry interfaces with the switch such that the switch is: a) in the open state when the LED circuit arrangement is operating in the normal operating state; and b) in the engaged state when the LED circuit arrangement is operating in the failed operating state. In the engaged state, the switch may be closed (e.g., the switch may operate in a linear mode where an effective resistance of the switch can be dependent upon a gate bias value applied to the switch) or alternatively may operate in a switching state/mode where the switch modulates/alternates between open and closed positions to provide the current correction string with a particular effective resistance. In certain examples, each of the LED strings has a normal LED string resistance value which represents the total resistance across one of the LED strings when the LED string is operating normally. In the situation where one of the LED strings fails, the current correction string can have an effective resistance value that corresponds to the normal LED string resistance value.

Another aspect of the present disclosure relates to a fail-safe LED system including a plurality of LED strings arranged in parallel with respect to each other. The LED strings each include at least one LED or a plurality of serially arranged LEDs. The fail-safe LED system also includes a current correction string arranged in parallel with respect to the plurality of LED strings, and a monitoring circuit for monitoring a state of operation of the plurality of LED strings. The state of operation includes a normal operating state and a failed operating state. When the plurality of LED strings is operating in the normal operating state, all of the LED strings are operating normally. When the plurality of LED strings is operating in the failed operating state, at least one of the LED strings has failed so as to have an open circuit. The fail-safe LED system further includes a switch controlled by the monitoring circuit. The switch is positioned along the current correction string. The switch is open when the state of operation of the plurality of LED strings is the normal operating state. The switch is engaged when the state of operation of the plurality of LED strings is the failed operating state. The current correction string has an effective resistance that controls current flow through the current correction string during the failed operating state such current flow through the remaining operational LED strings corresponds to the current flow through the LED strings in the normal operating state.

A further aspect of the present disclosure relates to a fail-safe LED system including an LED circuit arrangement having a plurality of LED strings arranged in parallel with respect to each other. The LED strings each include at least one LED or a plurality of serially arranged LEDs. The LED arrangement is supplied with electrical current from a constant current power supply. The fail-safe LED system also includes means for detecting a failure in at least one of the LED strings that causes increased current, relative to normal operation, to pass through the remaining operational LED strings of the plurality of LED strings. The fail-safe LED system further includes a current correction string arranged in parallel with respect to the plurality of LED strings. The current correction string includes means for causing the current passing through each operational LED string to be reduced to a corrected current level when a failure is detected.

Still another aspect of the present disclosure relates to a method for preventing an LED circuit arrangement from exceeding a predetermined temperature. The LED circuit arrangement includes a plurality of LED strings arranged in parallel with respect to each other. The LED strings each include at least one LED or a plurality of serially arranged LEDs. The LED arrangement is supplied with electrical current from a constant current power supply. The method includes detecting a failure in at least one of the LED strings that causes increased current, relative to normal operation, to pass through the remaining operational LED strings of the plurality of LED strings. The method also includes activating a current correction string arranged in parallel with respect to the plurality of LED strings such that current flows through the current correction string. The amount of current passing through the current correction string is sufficient to cause the current passing through the operational LED strings to be reduced to a level where the LEDs of the operational LED strings do not exceed the predetermined temperature.

Still another aspect of the present disclosure relates to a method for controlling current levels in an LED circuit arrangement. The LED circuit arrangement includes a plurality of LED strings arranged in parallel with respect to each other. The LED strings each include at least one LED or a plurality of serially arranged LEDs. The LED arrangement is supplied with electrical current from a constant current power supply. The method includes detecting a failure in at least one of the LED strings that causes increased current, relative to normal operation, to pass through remaining operational LED strings of the plurality of LED strings. The method also includes activating a current correction string arranged in parallel with respect to the plurality of LED strings. The current correction string has an effective resistance which allows sufficient current flow through the current correction string to cause the current passing through each operational LED string to be reduced to a corrected current level.

A further aspect of the present disclosure relates to methods and systems for controlling current levels in multi-string LED systems. In certain examples, the multi-string LED systems include a plurality of LED strings arranged in parallel with respect to one another, and a constant current power supply (e.g., a constant current LED driver) for providing current for powering the LEDs of the LED strings. In a condition in which one of the LED strings fails, the current that would typically pass through the failed LED string is forced to pass through the remaining operational LED strings. Thus, excess current passes through the operational LED strings thereby increasing the likelihood of increased temperatures at the LEDs. To counteract the increased current directed from the constant current power supply through the operational LED strings, aspects of the present disclosure relate to directing at least a portion of the excess current through a current correction string arranged in parallel with respect to the plurality of LED strings. The current correction string is activated upon detection of a failure of one or more of the LED strings. Since at least a portion of the excess current from the constant current LED driver is accommodated by the current correction string, such excess current does not pass through the operational LED strings. In this way, the amount of current passing through the operational LED strings can be controlled (i.e., limited).

A variety of additional inventive aspects will be set in the description that follows. The inventive aspects can relate to individual features and to combinations of features. It is to be understood that both the forgoing general description and the following detailed description are exemplary and explanatory only and are not restrictive of the broad inventive concepts upon which the examples disclosed herein are based.

DETAILED DESCRIPTION

Figure 1:
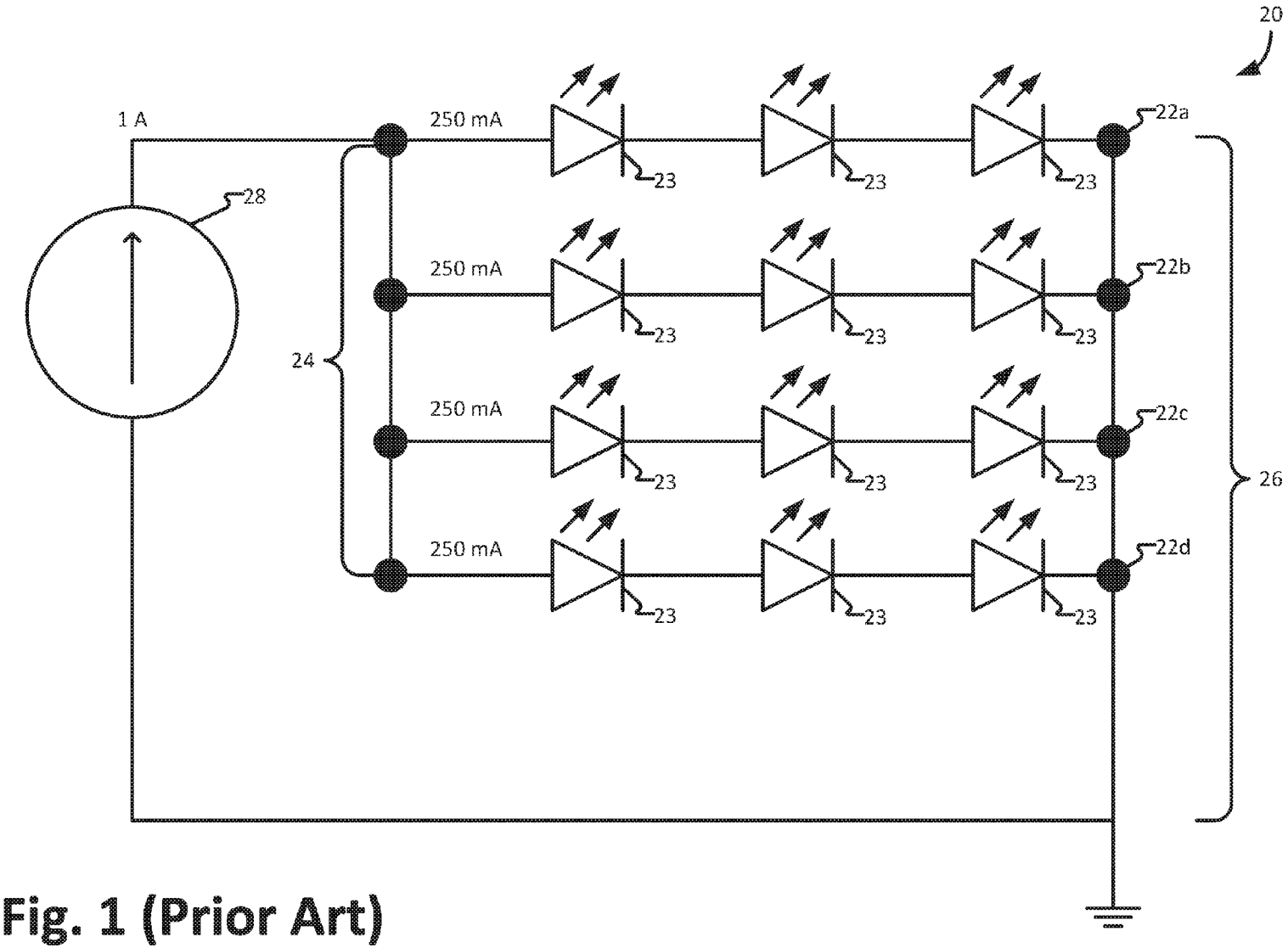
Fig. 1 (Prior Art)
FIG. 1 is a schematic diagram of a prior art LED system operating in a normal state.

Various examples will be described in detail with reference to the drawings, wherein like reference numerals represent like parts and assemblies throughout the several views. Any examples set forth in this disclosure are not intended to be limiting and merely set forth some of the many possible ways for implementing the broad inventive aspects disclosed herein.

FIG. 1 depicts a prior art LED system 20 including four LED strings 22*a*-22*d* (generally, LED string 22) arranged in parallel with respect to one another. The LED strings 22 extend between an anode side 24 and a cathode side 26 of the LED system 20. A constant current LED driver 28 (i.e., a constant current power source) is coupled to the anode side 24 of the LED system 20. Each LED string 22 includes at least one LED 23, and when the LED string 22 includes a plurality of LEDs 23, the LEDs 23 are serially arranged with respect to one another. The constant current LED driver 28 provides constant current to the LED strings 22*a*-22*d* for powering the LEDs 23.

For the purposes of illustration, the constant current LED driver 28 is shown providing one amp of constant current to the LED strings 22*a*-22*d*. The current is divided equally between the LED strings 22*a*-22*d* such that 250 milliamps flow through each of the LED strings 22*a*-22*d*. Thus, when the LED system 20 is functioning normally, equal levels of current flow through each of the LED strings 22*a*-22*b* of the LED system 20. It will be appreciated that the current magnitudes included herein have been selected for illustration purposes and are not intended to be representative of current levels provided in an actual LED system.

Figure 2:
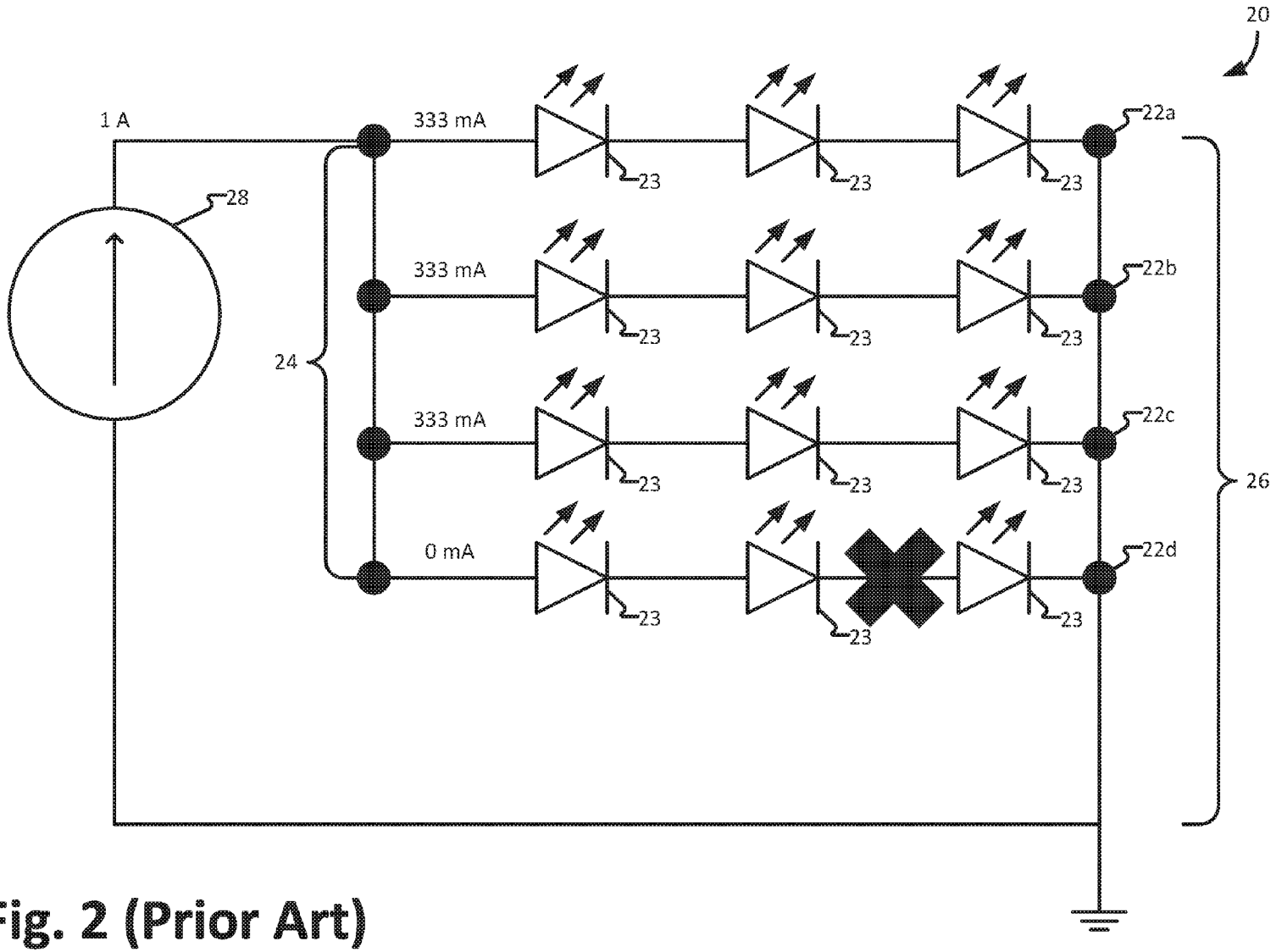
Fig. 2 (Prior Art)
FIG. 2 is a schematic diagram of the prior art LED system of FIG. 1 operating in a failed state in which one of the LED strings has failed.

FIG. 2 shows the LED system 20 operating in a failed operating state. In the depicted failed operating state, the fourth LED string 22*d* has failed so as to function as an open circuit. Thus, little to no current is permitted to pass through the fourth LED string 22*d* between the anode side 24 and the cathode side 26 of the LED system 20. In this condition, all of the current (e.g., one amp) delivered by the constant current LED driver 28 is required to pass through the three remaining LED strings 22*a*-22*c* that are operational. Thus, excess current passes through the remaining operational LED strings 22*a*-22*c* as compared to when the LED system 20 is operating normally. For example, assuming the constant current LED driver 28 provides one amp of current, each of the remaining operational LED strings 22*a*-22*c* carries about 333 milliamps of current. Thus, each of the operational LED strings 22*a*-22*c* carries about 83 milliamps of excess current, which represents a 33% increase in current level as compared to when the LED system 20 is operating normally. Increased current levels result in significantly increased heating of the elements of the LED system 20, which may lead to safety hazards (e.g., an ignition source) or reduced life for the elements.

Pertinent standards and regulations relating to devices used in hazardous (classified) locations dictate that temperature codes are to be based on the hottest component of a device which will potentially be exposed to explosive gases. An LED junction is typically the hottest point in an LED system 20, but it is hermetically sealed from the environment and therefore cannot be the ignition source. Therefore, the hottest component is typically the surface temperature (i.e., lens) of the LED 23. When determining compliance with pertinent standards, tests are typically conducted when all LEDs 23 in the LED systems 20 are fully functional. Thus, such tests do not account for certain failure modes that may cause operation at higher temperatures. One example failure mode is described with respect to FIG. 2, where an LED string 22 in a parallel LED string device fails causing excess current to be directed through the remaining operational LED strings 22. Due to LED failure, an LED device installed at a given location (e.g., a hazardous or classified location) may operate at temperatures that exceed the temperature threshold set by pertinent standards for the given location in which the LED device is installed. In such a situation, the increased temperature can represent an ignition source, and the LED device may be unsafe for the given installation.

Example standards having applicability or potential applicability to LED luminaires can include: UL 844 (Underwriters Laboratories Standard for use in hazardous (classified) locations); UL 8750 (Underwriters Laboratories Standard for Light Emitting Diode Equipment); the National Electric Code (NEC) series of hazardous location standards; and the International Electrotechnical Commission (IEC) 60079 series of hazardous location standards. It will be appreciated that the various aspects of the present disclosure are applicable to both equipment rated for use in hazardous applications (e.g., NEC Class I and Class II, Division 1 or 2 rated) and equipment that is not rated for hazardous applications.

Aspects of the present disclosure relate to systems, methods, devices, arrangements and configurations for preventing occurrences of excess current in a multi-string LED system. In certain examples, the multi-string LED system includes a plurality of LED strings 130*a*-*d* (generally, LED strings 130) arranged in parallel with respect to one another that are driven by a constant current LED driver 122 or other types of constant current power sources. To prevent an increased percentage of the total current from the constant current LED driver 122 from being directed through operational LED strings 130 upon failure of one or more of the LED strings 130, the LED system 120 includes a current correction string 134 that accommodates current that would otherwise flow through the failed LED string or strings 130. Upon failure of the LED string or strings 130, the current correction string 134 is engaged such that the current that would otherwise be flowing through the failed LED string or strings 130 flows through the current correction string 134. In this way, excess current is not required to pass through the operational LED strings 130. This excess current is instead accommodated at least partially by the current correction string 134. The activation of the current correction string 134 allows the operational LED strings 130 to carry generally the same amount of current that such LED strings 130 carried before LED string failure occurred. Since the current levels flowing through the operational LED strings 130 do not increase in a meaningful way, the operational LED strings 130 do not experience increased heating. Therefore, even in a condition where one or more of the LED strings 130 were to fail, the LED device would remain in compliance with any operating temperature requirements set forth by applicable standards.

Figure 3:
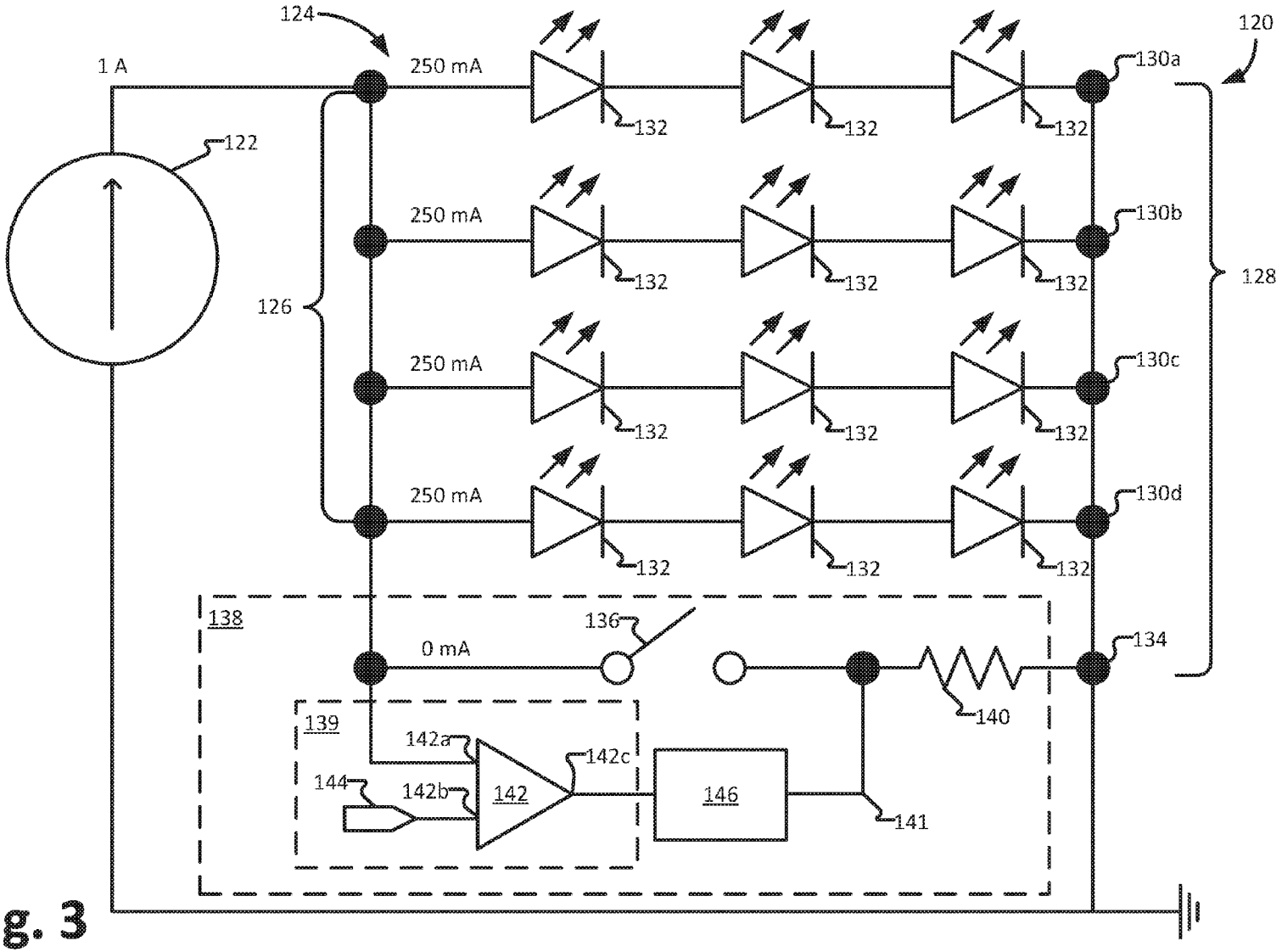
FIG. 3 is a schematic diagram of a fail-safe LED system in accordance with the principles of the present disclosure operating in a normal operating state.

FIG. 3 illustrates a fail-safe LED system 120 in accordance with the principles of the present disclosure. The fail-safe LED system 120 includes a constant current LED driver 122 or another type of constant current power supply. The fail-safe LED system 120 also includes an LED circuit arrangement 124 having an anode side 126 and a cathode side 128. The anode side 126 of the LED circuit arrangement 124 can also be referred to as the forward side of the LED circuit arrangement 124. The LED circuit arrangement 124 includes a plurality of LED strings 130 that extend between the anode and cathode sides 126, 128 of the LED circuit arrangement 124. The LED strings 130 are arranged in parallel with respect to one another. Each of the LED strings 130 include one LED 132 or a plurality of serially arranged LEDs 132 positioned between the anode and cathode sides 126, 128 of the LED circuit arrangement 124. The constant current LED driver 122 is coupled to the anode side 126 of the LED circuit arrangement 124 such that the constant current LED driver 122 is adapted to provide current to each of the LED strings 130 with the current being divided between the LED strings 130. In certain examples, the current is divided equally between the LED strings 130. In one example, the LED circuit arrangement includes current balancing circuitry for equally balancing current through the active parallel strings. In another example, the LED circuit arrangement does not include current balancing circuitry for equally balancing current through the active parallel strings. In certain examples, the LED strings have generally equal resistance values which causes generally equal levels of current to flow through each of the active LED strings.

The fail-safe LED system 120 also includes a current correction string 134 (i.e., a current correction line or branch) that extends between the anode and cathode sides 126, 128 of the LED circuit arrangement 124. The current correction string 134 is positioned in parallel with respect to the LED strings 130 of the LED circuit arrangement 124. The current correction string 134 can include a switch 136 having an open state (see FIG. 3) and an engaged state (see FIG. 5). In the open state, the switch 136 prevents current from flowing through the current correction string 134 between the anode and cathode sides 126, 128 of the LED circuit arrangement 124. In the engaged state, the switch 136 allows current to flow through the current correction string 134 between the anode and cathode sides 126, 128 of the LED circuit arrangement 124.

The switch 136 can be part of activation circuitry 138 used to activate the current correction string 134 (e.g., by engaging the switch). The activation circuitry 138 can also include monitoring circuitry 139 that monitors whether the LED circuit arrangement 124 is operating in a normal operating state (e.g., see FIG. 3) or a failed operating state (e.g., see FIGS. 4 and 5). The monitoring circuitry 139 interfaces with the switch 136 such that the switch is: a) in the open state when the LED circuit arrangement 124 is operating in the normal operating state; and b) in the engaged state (which includes a switching state or a closed state) when the LED circuit arrangement 124 is operating in the failed operating state. The activation circuitry 138 can further include current control circuitry for controlling the rate of current flow through the current correction string 134 when the current correction string 134 has been activated. In certain examples, the current correction circuitry can vary an effective resistance of the current correction string 134. In certain examples, the switch 136 can include a transistor that when activated by the activation circuitry is closed and operated in a linear mode, in which the effective resistance of the switch can be varied by varying the gate bias applied to the transistor. In other examples, the switch 136 can include a transistor that when activated by the activation circuitry is operated in switching mode, in which the switch modulates/alternates between open and closed states to provide the switch with an effective resistance.

The purpose of the current correction string 134 is to prevent excessive levels of current from passing through operational LED strings 130 when one or more of the LED strings 130 fail. In this regard, the current correction string 134 can have an effective resistance value that allows the current correction string 134 to accommodate sufficient current from the LED driver 122 during an LED string failure to prevent the current levels within the remaining operational LED strings 130 from exceeding predetermined thresholds. The effective resistance of the current correction string 134 is the total resistance provided by the current correction string 134 between the anode and cathode sides 126, 128. The effective resistance may be provided by one or more discrete resistors 140 positioned along the current correction string 134. The resistors 140 may each have constant resistance values. The effective resistance may also be provided by a resistance value of the switch 136. The resistance value of the switch 136 may be fixed or variable depending upon the type of switch 136 and how it is operated. The effective resistance value of the current correction string 134 can include the sum of the resistance of the resistor 140 and the resistance of the switch 136. In certain examples, the current correction string 134 may have an effective resistance value that is fixed or variable. Each of the LED strings 130 can have a normal LED string resistance value which represents the cumulative/total resistance across one of the LED strings 130 when the LED string 130 is operating normally. A simplified version of a system in accordance with the principles of the present disclosure can be designed to compensate for the failure of only one of the LED strings 130. This type of failure would result in one of the parallel LED strings 130 forming an open circuit. For this situation, the current correction string 134 can have a fixed effective resistance which corresponds to or approximates the normal LED string resistance value. In a more sophisticated version of the system, the current correction string 134 can have a variable effective resistance so that the current correction string 134 can have a first effective resistance if only one of the LED strings 130 has failed, and can have a lower effective resistance if two or more additional LED strings 130 fail. The use of variable effective resistance across the current correction string 134 can provide more precise current control through the current correction string 134 whether the current correction string 134 is providing current level compensation for a single failed LED string 130 or multiple failed LED strings 130.

FIG. 3 shows the fail-safe LED system 120 operating in the normal operating state. For illustration purposes only, example currents have been labeled on FIGS. 3-6. As depicted, the constant current LED driver 122 provides a one amp current to the anode side 126 of the LED circuit arrangement 124. The current is divided equally between the LED strings 130 such that 250 milliamps is shown passing through each of the LED strings 130. While the LED circuit arrangement 124 is operating normally, the switch 136 is in the open state, as shown in FIG. 3. With the switch 136 in the open state, no meaningful current passes through the current correction string 134.

Figure 4:
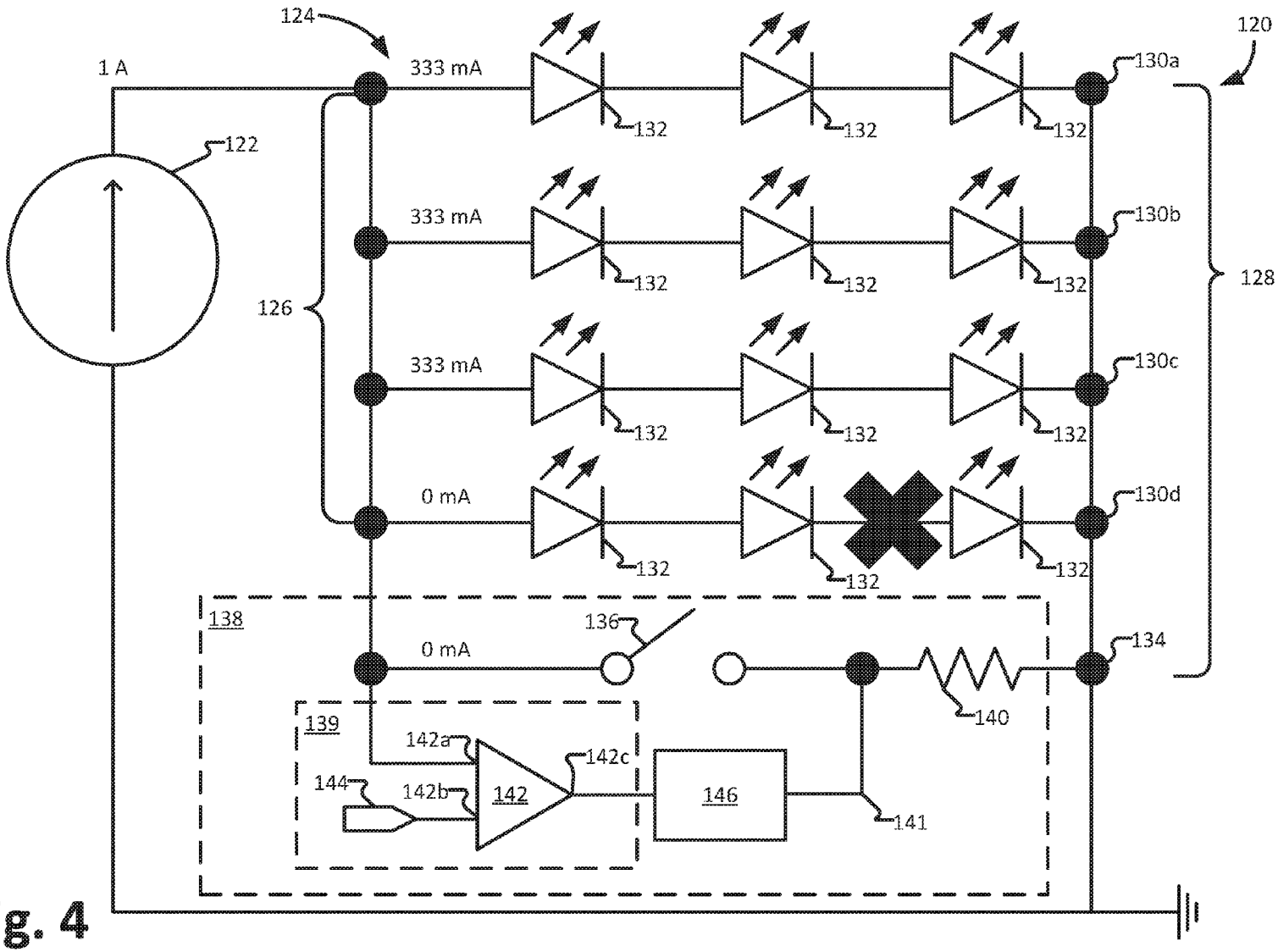
FIG. 4 is a schematic diagram of the fail-safe LED system of FIG. 3 operating in a failed operating state prior to implementation of corrective action.

In certain examples, a failed operating state relates to a failure in at least one of the LED strings 130 that causes increased current (e.g., an increased percentage of the total constant current provided by the constant current LED driver 122) to pass through remaining operational LED strings 130. For example, FIG. 4 depicts a condition in which fourth LED string 130*d* has failed so as to function as an open circuit. In this condition, the current that ordinarily would flow through the fourth LED string 130*d* is instead directed through LED strings 130*a*-130*c*. For example, the 1 amp of current from the constant current LED driver 122 is divided equally (e.g., 333 milliamps) through the operative LED strings 130*a*-130*c*. Thus, excess current is passed through LED strings 130*a*-130*c* which can result in increased heating and higher operating temperatures.

To prevent the increased current from passing through the LED strings 130*a*-130*c* for an extended period of time, the control circuitry 138 senses the failure in the LED circuit arrangement 124 and moves the switch 136 to the engaged state (see FIG. 5) which causes current to flow through the current correction string 134. In this way, the current correction string 134 can accommodate the current that would ordinarily be carried by the failed LED string 130*d*. Thus, the temporarily increased current flowing through the operational LED strings 130*a*-130*c* (e.g., 333 milliamps) is reduced to a corrected current level (e.g., 250 milliamps). Preferably, the corrected current level is sufficiently low such that the operational LED strings 130*a*-130*c* do not operate at increased temperatures that may exceed any pertinent temperature limitations set by relevant installation standards.

In certain examples, the effective resistance value of the current correction string 134 corresponds to the normal operating resistance of the failed LED string 130*d* such that the corrected current level established at each of the operational LED strings 130*a*-130*c* corresponds to the normal current level passing through each of the LED strings 130*a*-130*c* under normal operating conditions. In certain examples, the current correction string 134 has a current correction resistance value equal to or approximately equal to the normal operating resistance of the failed LED string 130*d*, and the corrected current level established at each of the operational LED strings 130*a*-130*c* equals, or approximately equals, the normal current level passing through each of the LED strings 130 under normal operating conditions.

It will be appreciated that FIGS. 3-6 are schematic in nature and are provided for illustration purposes only. It will be appreciated that the number of LEDs 132 provided along a given LED string 130 can vary depending upon the intended lighting application. Additionally, the number of parallel LED strings 130 can vary depending upon the desired lighting application. In certain examples, the LED circuit arrangement 124 can include at least three or four parallel LED strings 130. In other examples, the LED circuit arrangement 124 has no more than four parallel LED strings 130. In other examples, the circuit arrangement can include five or more parallel LED strings, or ten or more parallel LED strings. Thus, it will be appreciated that the number of LED strings present can vary greatly and is application dependent.

Figure 5:
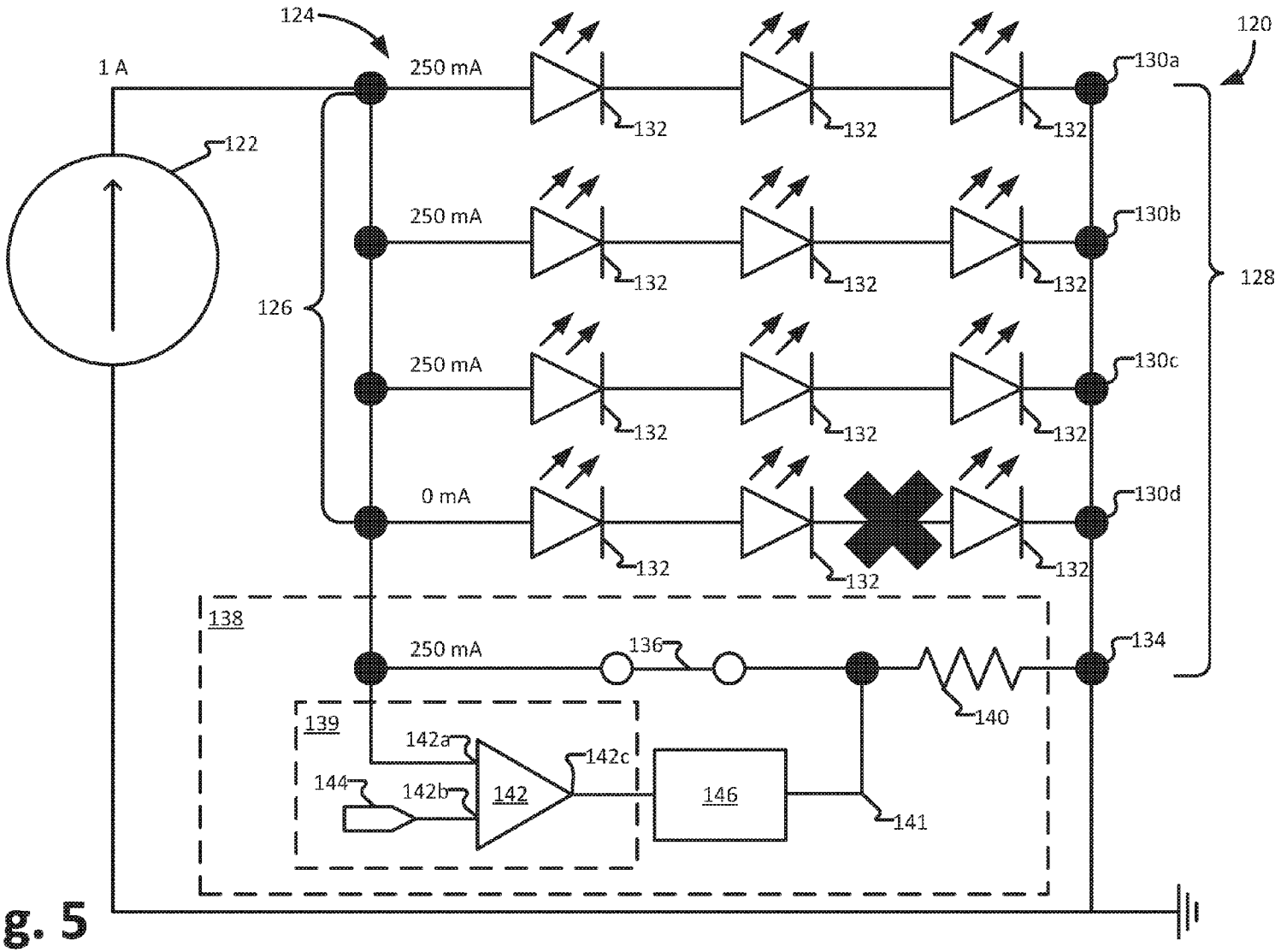
FIG. 5 is a schematic diagram of the fail-safe LED system of FIGS. 2 and 3 operating in the failed operating state, in this figure corrective action has been taken to limit current flow through operational LED strings of the LED system.

Referring to FIGS. 3-6, in the depicted example, it will be appreciated that the LED strings 130*a*-130*d* do not include separate independent current limiting controls corresponding to each of the parallel LED strings 130*a*-130*d* that control or limit the current passing through the LED strings. Additionally, it will be appreciated that in the normal operating state of FIG. 3, current from the constant current LED driver 122 is divided equally (within understood manufacturing tolerances) between the plurality of parallel LED strings 130*a*-130*d* which may be accomplished via each LED string 130 have an equal impedance or via current balancing circuits (not illustrated). Further, in the depicted example, only one current correction string 134 is provided for the plurality of parallel LED strings 130*a*-130*d* of the LED circuit arrangement 124. Additionally, it will be appreciated that engaging the switch 136 does not resume operation of the failed LED string 130*d*. Thus, moving the switch 136 to the engaged state, as shown in FIG. 5, does not cause current to resume flowing through the failed LED string 130*d*. Rather, the current correction string 134 functions as a surrogate for the failed LED string 130*d* and preferably has a resistance value equal to or approximately equal to the cumulative resistance value of the serially arranged LEDs 132 of the LED string 130*d*.

It will be appreciated that the monitoring circuitry 139 can detect a failure rather quickly so that the limited exposure of the LED strings 130*a*-130*c* to increased current levels does not result in meaningful heating or temperature increases. In certain examples, the failure can be detected and the switch 136 activated in less than one second, or in less than 0.5 seconds, or in less than or equal to 0.05 seconds.

In certain examples, the monitoring circuitry 139 monitors the LED circuit arrangement 124 by sensing voltage variations corresponding to the LED circuit arrangement 124. In certain examples, the monitoring circuitry 139 monitors the LED circuit arrangement 124 by sensing a voltage differential across the anode and cathode sides 126, 128 of the LED circuit arrangement 124. In certain examples, the monitoring circuitry 139 monitors the LED circuit arrangement 124 by comparing a voltage at the anode side of the LED circuit arrangement 124 relative to a reference voltage. In certain examples, the monitoring circuitry monitors the state of the LED circuit arrangement 124 by monitoring voltage magnitudes, voltage rates of change, or other voltage characteristics. In still other examples, the monitoring circuitry can monitor current related parameters such as rate of change of the current passing through a given line or lines. For example, current sensors can be provided at each of the LED strings 130. Referring to FIG. 5, once the switch 136 has been closed, current flows through the current correction string 134, thereby reducing the excess current that passes through the operational LED strings 130*a*-130*c*. As depicted at FIG. 5 for illustration purposes only, the constant current LED driver 122 provides one amp of current, and the operational LED strings 130*a*-130*c*, as well as the current correction string 134, each carry 250 milliamps of current. Thus, the current is equally divided between the operational LED strings 130*a*-130*c* and the current correction string 134. In the depicted example, the current correction string 134 carries the same amount of current that the LED string 130*d* carried prior to failure of the LED string 130*d*. Similarly, the LED strings 130*a*-130*c* carry the same amount of current that the LED strings 130*a*-130*c* carried prior to failure of the LED string 130*d*.

When the LED string 130*d* fails, as shown at FIG. 4, it will be appreciated that a voltage at the anode side 126 of the LED circuit arrangement 124 will increase. Therefore, voltage at the anode side 126 of the LED circuit arrangement 124 is an effective parameter that can be monitored to determine when a failure occurs in the LED circuit arrangement 124. Voltage levels at the anode side 126 can also be used to calculate or otherwise determine current flow rates through the various parallel LED strings 130.

It will be appreciated that the switch 136 can be any type of switch suitable for activating the current correction string 134. In certain examples, the switch 136 can be used to both activate and de-activate the current control string 134. In certain examples, the switch 136 can be a transistor such as a field effect transistor (e.g., an insulated gate field effect transistor such as an n-type metal-oxide-semiconductor field effect transistor (MOSFET), or a p-type MOSFET), a bipolar junction transistor, a relay or other general switching device. In some examples, the switch can be a simple on-off device. In other examples, the switch can provide resistance to the current correction string 134. In certain examples, the switch resistance is variable.

The constant current LED driver 122 can include any type of power source suitable for providing a constant current to the anode side 126 of the LED circuit arrangement 124. In certain examples, the constant current LED driver 122 includes a voltage source connected in series with constant current control circuits (like a linear regulator). It will be appreciated that any number of known constant current drivers can be used that include circuitry for outputting a constant current under varying load. It will be appreciated that a constant current power source can have the capacity of being set at different current levels, but includes circuitry that allows the power source to maintain the set current level under varying load.

In certain examples, the control circuitry 138 continuously monitors operation of the LED circuit arrangement 124. In certain examples, the control circuitry 138 continuously monitors a voltage parameter corresponding to the LED circuit arrangement 124. Referring to FIGS. 3-6, the control circuitry 138 is shown including a voltage comparator 142, but may include a microprocessor including instructions to compare voltages or a collection of logic gates to compare voltages. The voltage comparator 142 has a first voltage input 142*a* coupled to the anode side 126 of the LED circuit arrangement 124 and a second voltage input 142*b* coupled to a reference voltage source 144. The voltage comparator 142 has a voltage output 142*c* coupled to a switch controller 146. In certain examples, the switch controller 146 can be a gate drive or control circuitry for the switch 136. The voltage comparator 142 functions to continuously monitor and compare the voltage of the anode side 126 to the reference voltage. When the voltage comparison yields a difference in the voltage that exceeds a predetermined threshold, the comparator 142 can output a signal through the voltage output 142*c* to the switch controller 146. Upon receiving the voltage output from the voltage comparator 142, the switch controller 146 can cause the switch 136 to move from the open position of FIG. 3 to the closed position of FIG. 5. With the switch 136 closed (in a closed state or a switching state), current can pass through the current correction string 134 and the resistor 140.

Figure 6:
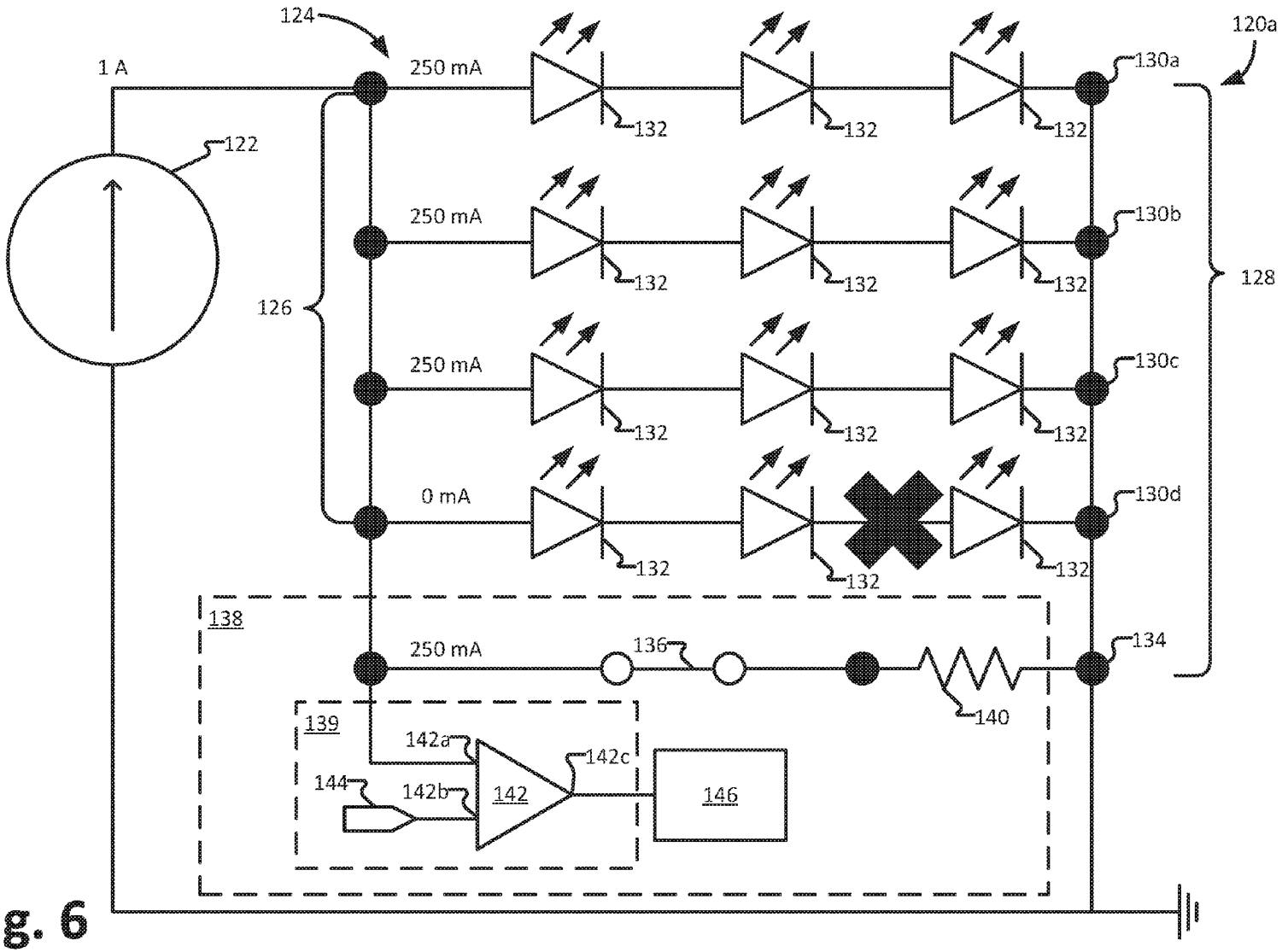
FIG. 6 is a schematic diagram of another fail-safe LED system in accordance with the principles of the present disclosure.

It will be appreciated that control arrangements in accordance with the present disclosure can be analog or digital. Also, control systems in accordance with the principles of the present disclosure can be closed loop or open loop. The fail-safe LED system 120 of FIG. 5 includes a feed-back circuit path 141 that provides a voltage feedback signal to the switch controller 146 for use in providing closed loop control of the current through the current correction string 134. FIG. 6 shows another fail-safe LED system 120*a* having the same basic configuration and components as the fail-safe LED system 120 of FIGS. 3-5, but with open loop current control instead of closed loop current control. The open loop current control can be based on a voltage reading at the anode side 126 of the LED circuit arrangement 124.

It will be appreciated that the switch 136 can be used to vary the effective resistance of the current control string 134 so as to function as current control circuitry. For example, a MOSFET can be operated in a linear mode where the resistance provided between the source and drain terminals of the switch varies with the magnitude of the voltage signal provided to the gate of the MOSFET. Thus, when operated in a linear mode, a MOSFET switch can function as a variable resistor. In other examples, a MOSFET or similar device can be modulated between open and closed positions (e.g., via digital control) at certain frequency and duty ratio in a switching state to achieve a variable effective resistance of the current control string 134.

As used herein, a value "corresponds" to a target value when the value is within plus or minus 10 percent of the target value. As used herein, a value is "approximately equal" to a target value when the value is within plus or minus 5 percent of the target value. It will be appreciated that the levels of correction provided by current correction strings in accordance with the principles of the present disclosure are dependent upon the specific operating characteristics of the systems into which the current correction strings are integrated. For example, for systems where minor current and/or temperature variations are unacceptable from a safety and/or operational perspective, current corrections strings in accordance with the principles of the present disclosure can be configured to precisely match the current passing through and the operational LED strings after a failure with the current passing through the LED strings before the failure (e.g., within 1, 2, 3, 4, 5, 6, 7, 8, 9 or 10 percent). In contrast, for systems having more relaxed operating parameters where fairly significant variations in current and temperature will remain in compliance with relevant safety and operational requirements, current correction strings in accordance with the principles of the present disclosure can be configured to provide just enough correction to ensure the system remains in compliance with the safety and operational requirements. Thus, the precision of current correction provided can be application dependent. In certain examples, the current correction can provide a current reduction of at least 5, 10, 20, 30, 40, 50, 60, 70, 80, 90, 95 or 100 percent of the increase in current provided to an operational LED as a result of a failure in at least one of the LED strings of a given parallel LED string arrangement.

As used herein, a string is an electrical line or path that extends between an anode side and a cathode side of a circuit arrangement. As used herein, an LED string is a string that includes at least one LED and often includes a plurality of serially arranged LEDs.

In a first aspect, the present disclosure is practiced as a fail-safe LED system comprising: a constant current power source; an LED circuit arrangement having an anode side and a cathode side, the LED circuit arrangement including a plurality of LED strings extending between the anode and cathode sides of the LED circuit arrangement, the LED strings being arranged in parallel with respect to one another, the constant current power source being coupled to the anode side of the LED circuit arrangement such that the constant current power source is adapted to provide current to each of the LED strings with the current being divided between the LED strings; and a current correction string that extends between the anode and cathode sides of the LED circuit arrangement, the current correction string being positioned in parallel with respect to each of the LED strings of the LED circuit arrangement, the current correction string being activated upon failure of at least one LED string of the plurality of LED strings such that the current correction string accommodates at least some current that would have passed through the at least one LED string had the at least one LED string not failed.

In a second aspect, the present disclosure is practiced as a fail-safe LED system comprising: an LED circuit arrangement, the LED circuit arrangement including a plurality of LED strings arranged in parallel with respect to each other, the LED arrangement being supplied with electrical current from a constant current power supply; a means for detecting in at least one of the LED strings a failure that causes increased current to pass through remaining operational LED strings of the plurality of LED strings; and a current correction string arranged in parallel with respect to the plurality of LED strings, the current correction string including means for causing the current passing through each operational LED string to be reduced to a corrected current level when a failure is detected.

In various aspects of a fail-safe LED system, when activated, the current correction string has an effective resistance which allows sufficient current flow through the current correction string to cause the current passing through each operational LED string to equal a corrected current level, and wherein the corrected current level established at each of the operational LED strings after failure of the at least one LED string corresponds to a normal current level that passes through each of the LED strings under normal operating conditions prior to failure of the at least one LED string.

In additional aspect of a fail-safe LED system, when activated, the current correction string has an effective resistance which allows sufficient current flow through the current correction string to cause the current passing through each operational LED string to equal a corrected current level, and wherein the corrected current level established at each of the operational LED strings after failure of the at least one LED string approximates or is equal to a normal current level that passes through each of the LED strings under normal operating conditions prior to failure of the at least one LED string.

In further aspects of a fail-safe LED system, the current correction string includes a switch for activating the current correction string. In some examples, the switch is configured to vary an effective resistance of the current correction string. In other examples, the current correction string further comprises a resistor positioned in series with the switch. In some aspects, the switch is a field effect transistor.

In yet additional aspects of a fail-safe LED system, the current correction string has a duty ratio when operating in a switching state to affect a variable resistance. In yet further aspects of a fail-safe LED system the current correction string has an effective resistance that is variable.

Moreover, in some aspects, the fail-safe LED system further comprises activation circuitry for activating the current correction string upon failure of at least one LED in at least one of the LED strings. In some aspects, the activation circuitry includes monitoring circuitry for monitoring whether the LED circuit arrangement is operating in a normal operating state or a failed operating state. In some examples, the monitoring circuitry includes a comparator, which includes a voltage comparator in some aspects. In other aspects, the activation circuitry monitors the LED circuit arrangement by sensing voltage variations corresponding to the LED circuit arrangement. In further aspects, the activation circuitry monitors the LED circuit arrangement by sensing a voltage differential across the anode and cathode sides of the LED circuit arrangement. In yet further aspects, the activation circuitry monitors the LED circuit arrangement by comparing a voltage at the anode side of the LED circuit arrangement relative to a reference voltage. In further aspects of the fail-safe LED system, the current correction string includes a switch, and wherein the switch is part of the activation circuitry.

In some aspects of the fail-safe LED system the parallel LED strings of the LED circuit arrangement include at least two parallel LED strings. In various aspects of the fail-safe LED system the parallel LED strings of the LED circuit arrangement each include a plurality of serially arranged LEDs. In several aspects of the fail-safe LED system the plurality of LED strings do not include separate independent current controls in parallel corresponding to each of the parallel LED strings. In additional aspects of the fail-safe LED system, in a normal operating state, current from the constant current power source is divided equally between the plurality of parallel LED strings.

As will be appreciated with a fail-safe LED system, activating the current correction string does not cause current to resume flowing through the failed at least one LED string. Further, in some aspects, wherein only one current correction string is provided for the LED circuit arrangement of the fail-safe LED system.

In a third aspect, the present disclosure is practiced as a method for preventing an LED circuit arrangement from exceeding a predetermined temperature, the LED circuit arrangement including a plurality of LED strings arranged in parallel with respect to each other, the LED arrangement being supplied with electrical current from a constant current power supply, the method comprising:detecting a failure in at least one of the LED strings that causes increased current to pass through remaining operational LED strings of the plurality of LED strings; and engaging a current correction string arranged in parallel with respect to the plurality of LED strings such that current flows through the current correction string, wherein the amount of current passing through the current correction string is sufficient to cause the current passing through the operational LED strings to be reduced to a level where the LEDs of the operational LED strings do not exceed the predetermined temperature. In some aspects of the method, the current correction string has an effective resistance that prevents a forward voltage of the LED circuit arrangement from exceeding a predetermined voltage. In additional aspects of the method, a current level established at each of the operational LED strings after failure of the at least one LED string corresponds to a normal current level that passes through each of the LED strings under normal operating conditions prior to failure of the at least one LED string.

In a fourth aspect, the present disclosure if practiced as a method for controlling current levels in an LED circuit arrangement, the LED circuit arrangement including a plurality of LED strings arranged in parallel with respect to each other, the LED arrangement being supplied with electrical current from a constant current power supply, the method comprising: detecting a failure in at least one of the LED strings that causes increased current to pass through remaining operational LED strings of the plurality of LED strings; and activating a current correction string arranged in parallel with respect to the plurality of LED strings, the current correction string having a resistance which allows sufficient current flow through the current correction string to cause the current passing through each operational LED string to be reduced to a corrected current level. In some aspects of the method, the corrected current level established at each of the operational LED strings after failure of the at least one LED string corresponds to a normal current level that passes through each of the LED strings under normal operating conditions prior to failure of the at least one LED string. In other aspects of the method, the corrected current level established at each of the operational LED strings after failure of the at least one LED string approximates or is equal to a normal current level that passes through each of the LED strings under normal operating conditions prior to failure of the at least one LED string.

Various modifications and alterations of this disclosure will become apparent to those skilled in the art without departing from the scope and spirit of this disclosure, and it should be understood that the scope of this disclosure is not to be unduly limited to the illustrative examples set forth herein.

What is claimed is:

1. A fail-safe LED system comprising:

a constant current power source;

an LED circuit arrangement having an anode side and a cathode side, the LED circuit arrangement including a plurality of LED strings extending between the anode and cathode sides of the LED circuit arrangement, the LED strings being arranged in parallel with respect to one another, the constant current power source being coupled to the anode side of the LED circuit arrangement such that the constant current power source is adapted to provide current to each of the LED strings with the current being divided between the LED strings; and a current correction string that extends between the anode and cathode sides of the LED circuit arrangement, the current correction string being positioned in parallel with respect to each of the LED strings of the LED circuit arrangement, the current correction string being activated upon failure of at least one LED string of the plurality of LED strings such that the current correction string accommodates at least some current that would have passed through the at least one LED string had the at least one LED string not failed.

2. The fail-safe LED system of claim 1, wherein when activated the current correction string has an effective resistance which allows sufficient current flow through the current correction string to cause the current passing through each operational LED string to equal a corrected current level, and wherein the corrected current level established at each of the operational LED strings after failure of the at least one LED string corresponds to a normal current level that passes through each of the LED strings under normal operating conditions prior to failure of the at least one LED string.

3. The fail-safe LED system of claim 1, wherein the current correction string includes a switch for activating the current correction string.

4. The fail-safe LED system of claim 3, wherein the current correction string further comprises a resistor positioned in series with the switch.

5. The fail-safe LED system of claim 3, wherein the switch is a field effect transistor.

6. The fail-safe LED system of claim 1, wherein the current correction string has a duty ratio when operating in a switching state to affect a variable resistance.

7. The fail-safe LED system of claim 1, wherein the current correction string has an effective resistance that is variable.

8. The fail-safe LED system of claim 1, further comprising activation circuitry for activating the current correction string upon failure of at least one LED in at least one of the LED strings.

9. The fail-safe LED system of claim 8, wherein the activation circuitry includes monitoring circuitry for monitoring whether the LED circuit arrangement is operating in a normal operating state or a failed operating state.

10. The fail-safe LED system of claim 9, wherein the monitoring circuitry includes a comparator.

11. The fail-safe LED system of claim 9, wherein the activation circuitry monitors the LED circuit arrangement by sensing voltage variations corresponding to the LED circuit arrangement.

12. The fail-safe LED system of claim 11, wherein the current correction string includes a switch, and wherein the switch is part of the activation circuitry.

13. The fail-safe LED system of claim 9, wherein the activation circuitry monitors the LED circuit arrangement by sensing a voltage differential across the anode and cathode sides of the LED circuit arrangement.

14. The fail-safe LED system of claim 9, wherein the activation circuitry monitors the LED circuit arrangement by comparing a voltage at the anode side of the LED circuit arrangement relative to a reference voltage.

15. The fail-safe LED system of claim 1, wherein the parallel LED strings of the LED circuit arrangement each include a plurality of serially arranged LEDs.

16. The fail-safe LED system of claim 1, wherein, in a normal operating state, current from the constant current power source is divided equally between the plurality of parallel LED strings.

17. The fail-safe LED system of claim 1, wherein only one current correction string is provided for the LED circuit arrangement of the fail-safe LED system.

18. A method for preventing an LED circuit arrangement from exceeding a predetermined temperature, the LED circuit arrangement including a plurality of LED strings arranged in parallel with respect to each other, the LED arrangement being supplied with electrical current from a constant current power supply, the method comprising:

detecting a failure in at least one of the LED strings that causes increased current to pass through remaining operational LED strings of the plurality of LED strings; and engaging a current correction string arranged in parallel with respect to the plurality of LED strings such that current flows through the current correction string, wherein the amount of current passing through the current correction string is sufficient to cause the current passing through the operational LED strings to be reduced to a level where the LEDs of the operational LED strings do not exceed the predetermined temperature.

19. The method of claim 18, wherein the current correction string has an effective resistance that prevents a forward voltage of the LED circuit arrangement from exceeding a predetermined voltage.

20. The method of claim 18, wherein a current level established at each of the operational LED strings after failure of the at least one LED string corresponds to a normal current level that passes through each of the LED strings under normal operating conditions prior to failure of the at least one LED string.

21. A method for controlling current levels in an LED circuit arrangement, the LED circuit arrangement including a plurality of LED strings arranged in parallel with respect to each other, the LED arrangement being supplied with electrical current from a constant current power supply, the method comprising:

detecting a failure in at least one of the LED strings that causes increased current to pass through remaining operational LED strings of the plurality of LED strings; and activating a current correction string arranged in parallel with respect to the plurality of LED strings, the current correction string having a resistance which allows sufficient current flow through the current correction string to cause the current passing through each operational LED string to be reduced to a corrected current level.

22. The method of claim 21, wherein the corrected current level established at each of the operational LED strings after failure of the at least one LED string corresponds to a normal current level that passes through each of the LED strings under normal operating conditions prior to failure of the at least one LED string.

23. The method of claim 21, wherein the corrected current level established at each of the operational LED strings after failure of the at least one LED string approximates or is equal to a normal current level that passes through each of the LED strings under normal operating conditions prior to failure of the at least one LED string.

* * * * *